US010704229B2

(12) United States Patent
Uemura et al.

(10) Patent No.: US 10,704,229 B2
(45) Date of Patent: Jul. 7, 2020

(54) HYDRAULIC DRIVING APPARATUS OF WORK MACHINE

(71) Applicant: Kobe Steel, Ltd., Kobe-shi (JP)

(72) Inventors: Shohei Uemura, Kobe (JP); Naoki Sugano, Kobe (JP); Naoto Hori, Kobe (JP); Satoshi Maekawa, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 15/758,033

(22) PCT Filed: Aug. 26, 2016

(86) PCT No.: PCT/JP2016/074909

§ 371 (c)(1),
(2) Date: Mar. 7, 2018

(87) PCT Pub. No.: WO2017/047352

PCT Pub. Date: Mar. 23, 2017

(65) Prior Publication Data

US 2018/0251958 A1 Sep. 6, 2018

(30) Foreign Application Priority Data

Sep. 14, 2015 (JP) ..... 2015-180420

(51) Int. Cl.
*E02F 9/22* (2006.01)
*F15B 21/14* (2006.01)
(Continued)

(52) U.S. Cl.
CPC ..... *E02F 9/2217* (2013.01); *B66C 13/20* (2013.01); *B66D 1/44* (2013.01); *E02F 9/2016* (2013.01);
(Continued)

(58) Field of Classification Search
CPC ..... E02F 9/2217; E02F 9/2292; E02F 9/2239; E02F 9/2296; E02F 9/2246; E02F 9/2016;
(Continued)

(56) References Cited

U.S. PATENT DOCUMENTS 9,057,389 B2 * 6/2015 Opdenbosch ..... E02F 9/2217
2010/0236232 A1 9/2010 Boehm et al.
2013/0081385 A1 4/2013 Opdenbosch

FOREIGN PATENT DOCUMENTS

JP 2010-222967 A 10/2010

OTHER PUBLICATIONS

International Search Report dated Nov. 15, 2016 in PCT/JP2016/074909, filed Aug. 26, 2016.

* cited by examiner

*Primary Examiner* — Abiy Teka
(74) *Attorney, Agent, or Firm* — Oblon, McClelland, Maier & Neustadt, L.L.P.

(57) ABSTRACT

A hydraulic driving apparatus that drives a plurality of driving subjects and regenerates energy thereof. This hydraulic driving apparatus includes: a first pump motor; a second pump motor that is switchable between a state of moving a first driving subject by hydraulic oil discharged from the first pump motor and a state of being operated as a pump by means of energy of the first driving subject; a first pump motor line that couples the first and second pump motors with each other; a first accumulator connected to the first pump motor line; a regeneration subject hydraulic actuator that moves a second driving subject; a second accumulator that receives hydraulic oil from the regeneration subject hydraulic actuator; a second pump motor line that couples the second accumulator with the first pump motor; and a pressure release changeover valve that opens/closes the second pump motor line.

7 Claims, 10 Drawing Sheets

(51) Int. Cl.

| | |
|---|---|
| ***B66D 1/44*** | (2006.01) |
| ***E02F 9/20*** | (2006.01) |
| ***F15B 1/02*** | (2006.01) |
| ***B66C 13/20*** | (2006.01) |
| ***F15B 11/17*** | (2006.01) |

(52) U.S. Cl.

CPC ..... *E02F 9/2239* (2013.01); *E02F 9/2246* (2013.01); *E02F 9/2292* (2013.01); *E02F 9/2296* (2013.01); *F15B 1/024* (2013.01); *F15B 11/17* (2013.01); *F15B 21/14* (2013.01); *F15B 2201/51* (2013.01); *F15B 2211/20546* (2013.01); *F15B 2211/20569* (2013.01); *F15B 2211/20576* (2013.01); *F15B 2211/212* (2013.01); *F15B 2211/3057* (2013.01); *F15B 2211/3058* (2013.01); *F15B 2211/30505* (2013.01); *F15B 2211/30565* (2013.01); *F15B 2211/31588* (2013.01); *F15B 2211/611* (2013.01); *F15B 2211/625* (2013.01); *F15B 2211/6306* (2013.01); *F15B 2211/7053* (2013.01); *F15B 2211/7058* (2013.01); *F15B 2211/7135* (2013.01); *F15B 2211/761* (2013.01); *F15B 2211/763* (2013.01); *F15B 2211/853* (2013.01)

(58) Field of Classification Search

CPC ..... F15B 21/14; F15B 1/024; F15B 11/17; B66C 13/20; B66D 1/44

See application file for complete search history.

HYDRAULIC DRIVING APPARATUS OF WORK MACHINE

TECHNICAL FIELD

The present invention relates to a hydraulic driving apparatus installed on a work machine such as a hydraulic shovel.

BACKGROUND ART

The hydraulic driving apparatus installed on the work machine generally includes a hydraulic pump that discharges hydraulic oil, and a hydraulic actuator that receives the hydraulic oil discharged by the hydraulic pump, and operates so as to move a driving subject, and there has been known a technology of using a so-called pump motor where the hydraulic actuator simultaneously has a pump function and a motor function in order to conversely regenerate an energy by means an external force given by the driving subject in recent years.

For example, Patent Document 1 discloses an apparatus including multiple reversible adjustment units, each of which is a so-called pump motor. This apparatus includes a first reversible adjustment unit E1 and a second reversible adjustment unit E2 provided in a rotation driving circuit that rotates a rotating body, and a third reversible adjustment unit E3 and a fourth reversible adjustment unit E4 provided in a boom driving circuit including a boom cylinder that drives a boom.

The first reversible adjustment unit E1 operates as a pump that discharges hydraulic oil, and the second reversible adjustment unit E2 operates as a motor that receives a supply of the hydraulic oil, and rotates the rotating body when the rotation driving is carried out in the rotation driving circuit. On the other, the second reversible adjustment unit E2 operates as a pump that discharges the hydraulic oil at a high pressure by means of rotation energy of the rotating body, and the hydraulic oil at the high pressure is accumulated in a pressure accumulator Spr provided in the rotation driving circuit during a rotation deceleration. The high pressure oil accumulated in the pressure accumulator Spr is used as power to assist an engine via the reversible adjustment unit E1 depending on necessity, and the rotation energy of the rotating body during the rotation deceleration is regenerated an a result.

In the boom driving circuit, energy of the hydraulic oil discharged from the boom cylinder during a boom down operation can be accumulated via the reversible adjustment units E3 and E4 in a pressure accumulator Sph provided in the boom driving circuit, or can be supplied to the pressure accumulator Spr in the rotation driving circuit. On the other hand, the energy accumulated in the pressure accumulators Spr and Sph is converted to power via the reversible adjustment units E3, E4, and E1, thereby contributing the assist for the engine during a boom up operation.

However, the pump motor constructing the reversible adjustment unit simultaneously has the function as the hydraulic pump and the function as the hydraulic motor, and is thus expensive compared with general hydraulic pump and hydraulic motor. In the apparatus described in Patent Document 1, each of the rotation driving circuit and the boom driving circuit needs to include the multiple pump motors, the required number of the pump motors is thus large, and consequent excessive increases in cost and installation space cannot be avoided.

CITATION LIST

Patent Document

Patent Document 1: JP 2010-222967 A

SUMMARY OF INVENTION

It is therefore an object of the present invention to provide a hydraulic driving apparatus capable of driving multiple driving subjects in a work machine, and regenerating energy thereof by a simple and low-cost configuration.

Provided is a hydraulic driving apparatus for respectively driving a first driving subject and a second driving subject included in a work machine by means of a hydraulic pressure, including a first pump motor that can be switched between a first pump operation state of being driven by a prime mover, thereby sucking hydraulic oil for driving the first driving subject from a tank, and discharging the hydraulic oil and a first motor operation state of receiving a supply of the hydraulic oil, thereby generating power, a second pump motor that is coupled to the first driving subject, and can be switched between a second motor operation state of receiving a supply of the hydraulic oil discharged from the first pump motor in the first pump operation state, thereby moving the first driving subject and a second pump operation state of receiving a supply of energy held by the first driving subject, thereby operating so as to suck the hydraulic oil from the tank, and discharge the hydraulic oil, a first pump motor line that connects the first pump motor and the second pump motor with each other so that the hydraulic oil can be supplied from the first pump motor to the second pump motor, a first accumulator that is connected to the first pump motor line, and receives the hydraulic oil discharged from the second pump motor in the second pump operation state, thereby accumulating a pressure, a pressure holding valve that is interposed between the first accumulator and the first pump motor, and preventing a pressure release from the first accumulator to the first pump motor so as to hold the pressure in the first accumulator, a regeneration subject hydraulic actuator that is coupled to the second driving subject, and receives a supply of the hydraulic oil, thereby moving the second driving subject, a hydraulic pump that sucks the hydraulic oil to be supplied to the regeneration subject hydraulic actuator from the tank, and discharges the hydraulic oil, a second accumulator that receives the hydraulic oil pressurized by means of energy held by the second driving subject, and discharged from the regeneration subject hydraulic actuator, thereby accumulating a pressure, a second pump motor line that connects the second accumulator to the first pump motor so that the pressure of the hydraulic oil accumulated in the second accumulator is released to the first pump motor in the first motor operation state, thereby enabling the drive of the first pump motor, and a pressure release changeover valve that can be switched between an open state of opening the second pump motor line, thereby enabling the pressure release from the second accumulator to the first pump motor and a closed state of blocking the second pump motor line, thereby blocking the pressure release.

DESCRIPTION OF EMBODIMENTS

A description will now be given of embodiments of the present invention with reference to drawings.

Figure 10:
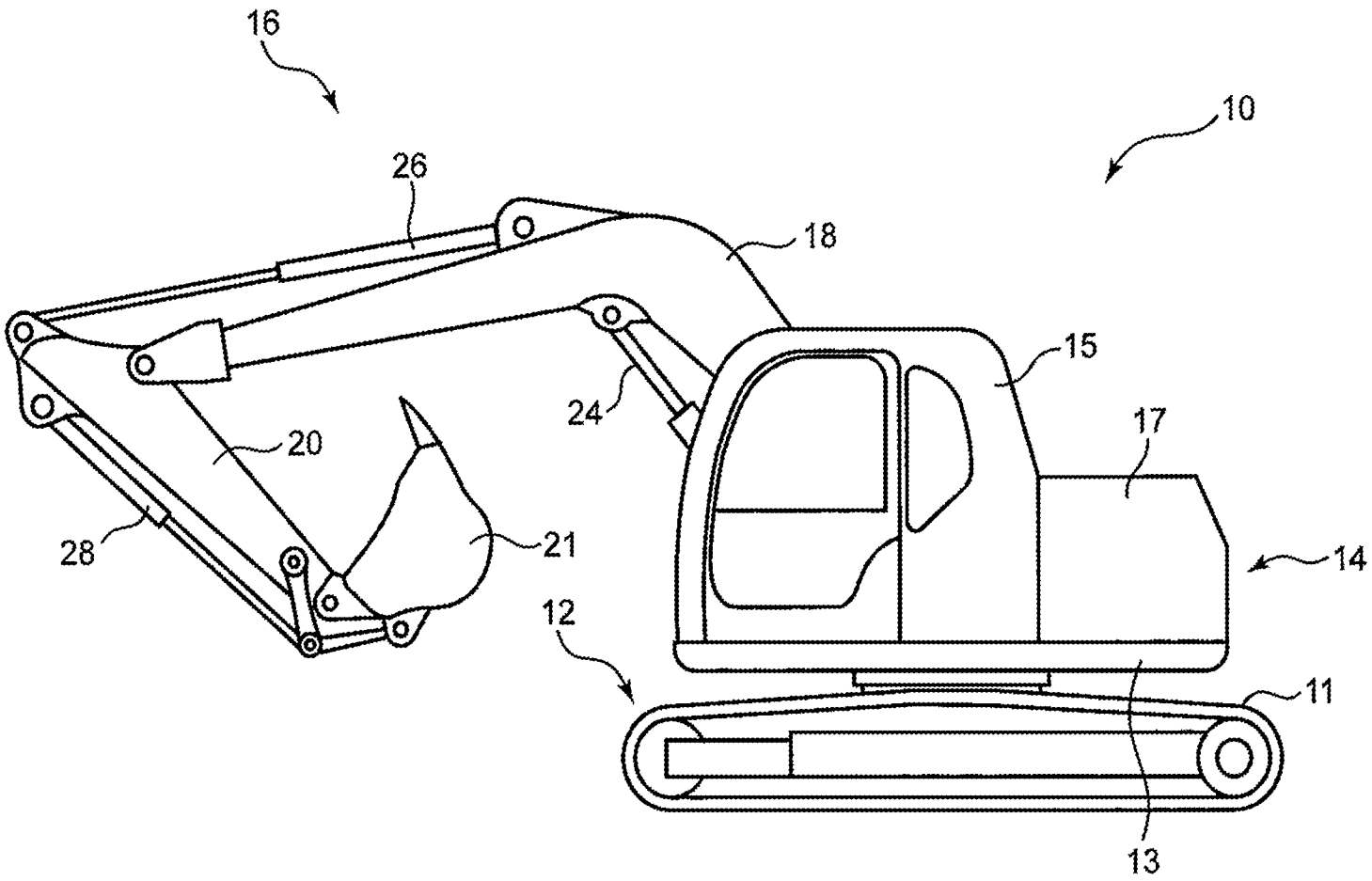
FIG. 10 is a front view of a hydraulic shovel, which is an example of a work machine on which the hydraulic driving apparatus according to each of the embodiments is mounted.

FIG. 10 is a view of an external appearance of a hydraulic shovel 10, which is an example of a work machine on which a hydraulic driving apparatus according to each of the respective embodiments described hereinafter is mounted. This hydraulic shovel 10 includes a lower traveling body 12, an upper rotating body 14 mounted for rotation about a vertical axis on the lower traveling body 12, and a work attachment 16, which is a work apparatus attached to the upper rotating body 14. The lower traveling body 12 includes a traveling apparatus 11 including, for example, a pair of crawlers. The upper rotating body 14 includes a rotating frame 13, a cabin 15 mounted on the rotating frame 13, and a counterweight 17. The work attachment 16 includes a boom 18 attached to the upper rotating body 14 for rising and falling, an arm 20 connected for turning to a distal end of the boom 18, and a bucket 22 connected for turning to a distal end of the arm 20.

A boom cylinder 24, an arm cylinder 26, and a bucket cylinder 28, which are multiple work hydraulic actuators, are attached to the work attachment 16. Each of these cylinders 24, 26, and 28 is constructed of a hydraulic cylinder with an extendable and contractible rod. The boom cylinder 24 is interposed between the boom 18 and the upper rotating body 14 so as to extend and contract as a result of reception of a supply of hydraulic oil, thereby turning the boom 18 in a rising/falling direction. The arm cylinder 26 is interposed between the arm 20 and the boom 18 so as to extend/contract as a result of reception of a supply of the hydraulic oil, thereby turning the arm 20 about a horizontal axis with respect to the boom 18. The bucket cylinder 28 is interposed between the bucket 22 and the arm 20 so as to extend/contract as a result of reception of a supply of the hydraulic oil, thereby turning the bucket 22 about a horizontal axis with respect to the arm 20.

Figure 1:
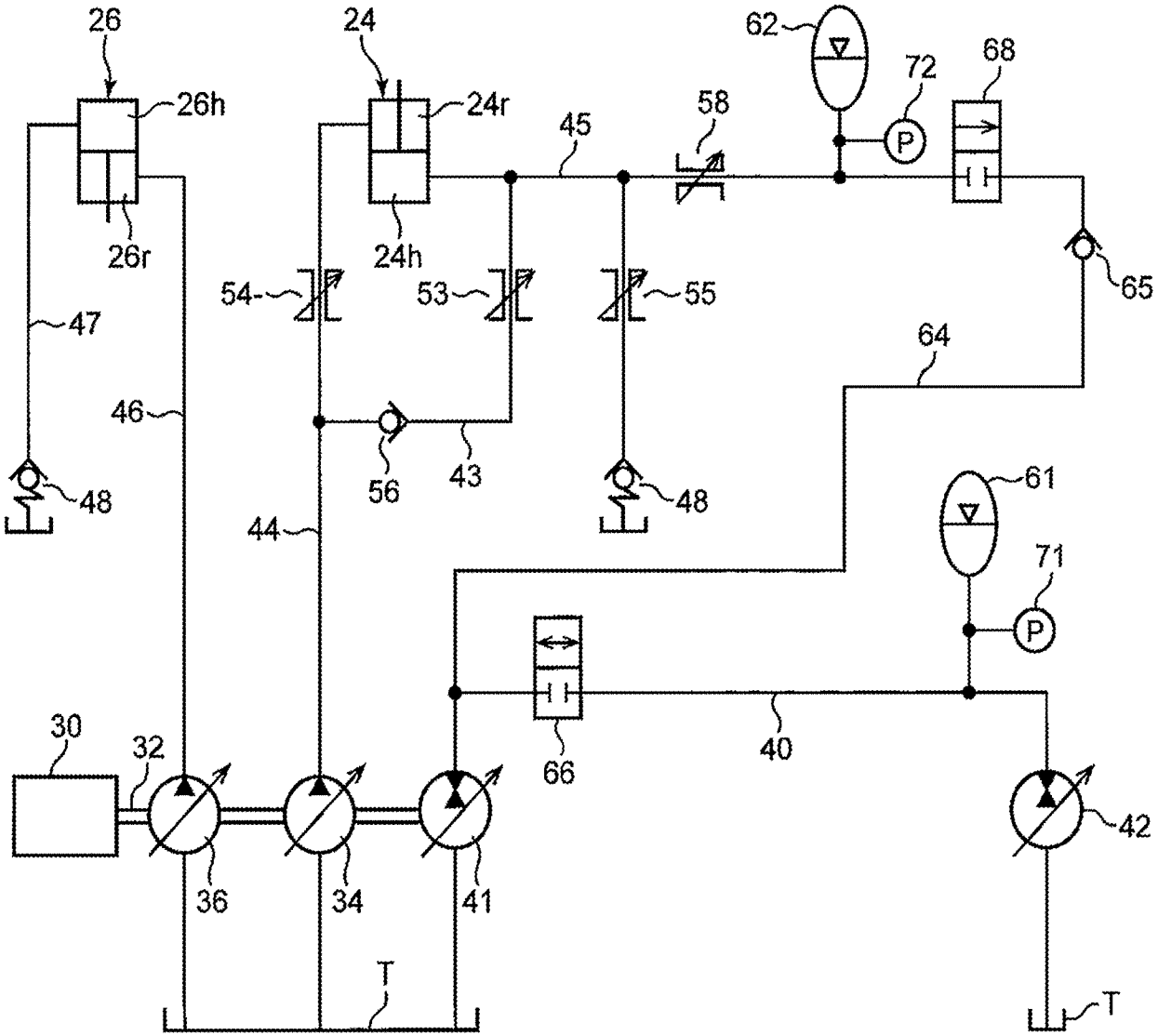
FIG. 1 is a circuit diagram of a hydraulic driving apparatus according to a first embodiment of the present invention.
Figure 2:
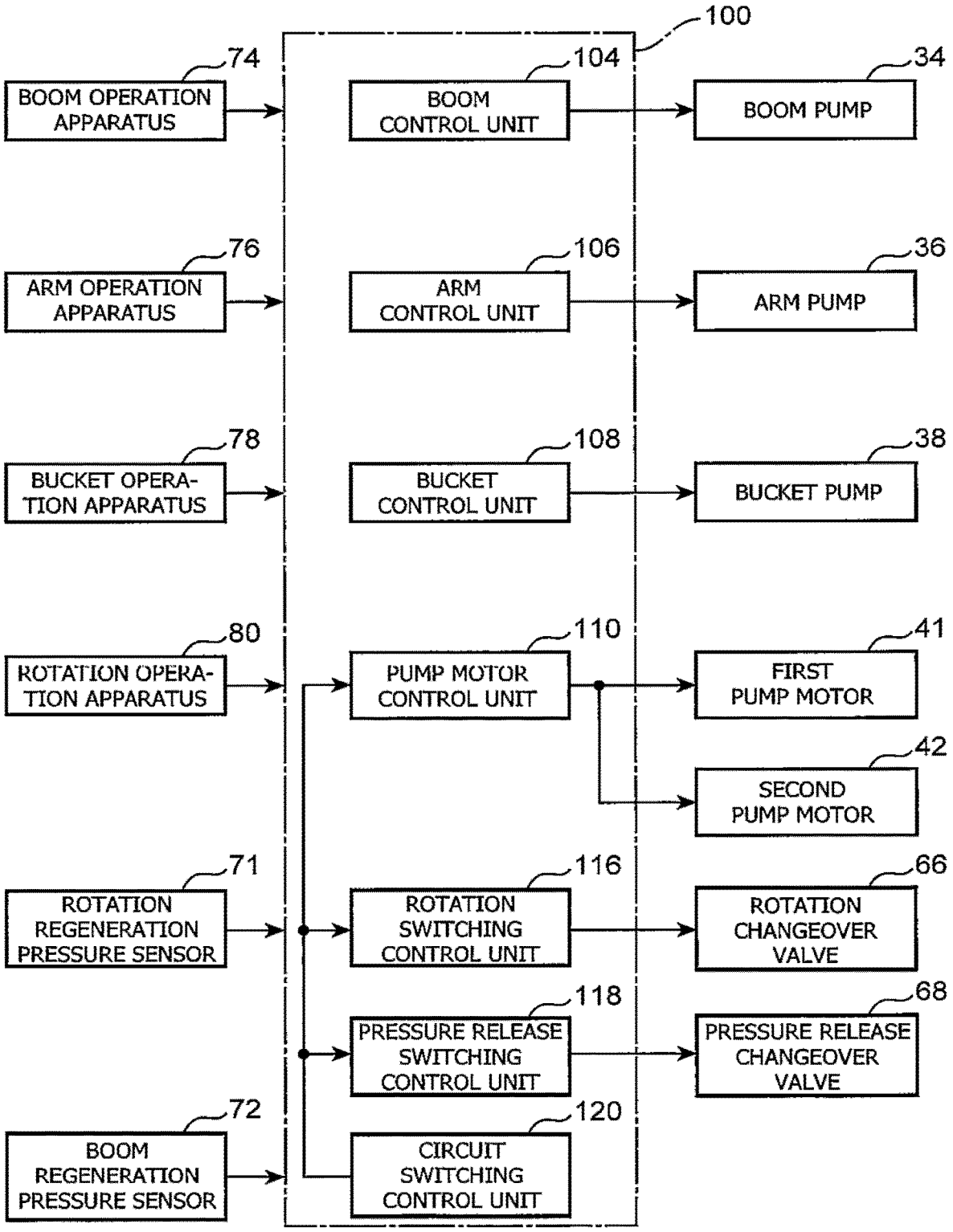
FIG. 2 is a block diagram of a functional configuration of a controller included in the hydraulic driving apparatus according to the first embodiment.

FIG. 1 shows the hydraulic driving apparatus according to a first embodiment of the present invention mounted on the hydraulic shovel. This hydraulic driving apparatus includes multiple hydraulic actuators including the respective cylinders 24, 26, and 28, multiple hydraulic pumps that suck the hydraulic oil from a tank, and discharge the hydraulic oil to the hydraulic actuators for respectively driving the multiple actuators, and a prime mover 30 that is connected to the multiple hydraulic pumps, and drives the hydraulic pumps. Any one of the multiple hydraulic pumps is of a variable displacement type, and the multiple hydraulic pumps include a boom pump 34 that discharges the hydraulic oil for driving the boom cylinder 24, an arm pump 36 that discharges the hydraulic oil for driving the arm cylinder 26, a bucket pump 38 (this bucket pump 38 is not shown in FIG. 1, but is shown in FIG. 2 described later) that drives the bucket cylinder 28, and a first pump motor 41 that discharges the hydraulic oil for rotating the upper rotating body 14, and are connected to a common output shaft 32 connected to the prime mover 30.

According to this embodiment, the upper rotating body 14 and the boom 18 respectively correspond to a first driving subject and a second driving subject according to the present invention, and the boom cylinder 24 corresponds to a regeneration subject hydraulic actuator that is connected to and moves the second driving subject. Thus, the boom pump 34 corresponds to a hydraulic pump that discharges the hydraulic oil to be supplied to the regeneration subject hydraulic actuator.

The first pump motor 41 is the hydraulic pump motor of the variable displacement type, and is configured to be able to change a displacement of the first pump motor 41 to both directions so as to be able to switch to a first pump operation state and a first motor operation state. The first pump motor 41 is driven by the prime mover 30, thereby sucking and discharging the hydraulic oil in the tank T in the first pump operation state, and is driven by reception of a supply of the hydraulic oil, thereby generating power, and imparting the power to the output shaft of the prime mover 30, thereby assisting the prime mover 30 in the first motor operation state.

The multiple hydraulic actuators include a second pump motor 42, which is a hydraulic actuator that rotates the upper rotating body 14, and is shown in FIG. 1, in addition to the respective cylinders 24, 26, and 28. The second pump motor 42 is a hydraulic pump motor of the variable displacement type as the first pump motor 41, and is configured to be able to change the displacement of the second pump motor to both directions so as to be able to switch to a second motor operation state and a second pump operation state.

The second pump motor 42 is connected via a first pump motor line 40 to the first pump motor 41. The second pump motor 42 receives a supply of the hydraulic oil discharged by the first pump motor 41 in the first pump operation state, thereby operating so as to rotate the upper rotating body 14, which is the first driving subject, in the second motor operation state. The second pump motor 42 receives a supply of (inertial) rotation energy held by the upper rotating body 14, thereby operating so as to suck and discharge the hydraulic oil in the tank T in the second pump operation state. The first pump motor line 40 connects both the pump motor 41 and 42 with each other so as to enable circulation of the hydraulic oil between the first pump motor 41 and the second pump motor 42.

A boom driving circuit, an arm driving circuit, and a bucket driving circuit are respectively provided between the boom cylinder 24 and the boom pump 34, between the arm cylinder 26 and the arm pump 36, and between the bucket cylinder 28 and the bucket pump 38. These driving circuits respectively connect the pumps 34, 36, and 38 and the cylinders 24, 26, and 28 with each other so as to supply the hydraulic oil discharged from the respective pumps 34, 36, and 38 to the respective cylinders 24, 26, and 28, and return the hydraulic oil discharged from the respective cylinders 24, 26, and 28 to the tank T.

FIG. 1 representatively shows a meter-in flow passage 46 and a meter-out flow passage 47 included in the arm driving circuit, and a meter-in flow passage 44, a meter-out flow passage 45, and a regeneration flow passage 43 included in the boom driving circuit out of lines included in the respective driving circuits for the sake of convenience.

The meter-in flow passage 46 in the arm driving circuit connects a discharge port of the arm pump 36 and a rod side chamber 26*r* of the arm cylinder 26 with each other so as to supply the hydraulic oil discharged by the arm pump 36 to the rod side chamber 26*r*. The meter-out flow passage 47 connects a head side chamber 26*h* of the arm cylinder 26 and the tank T with each other so as to return the hydraulic oil discharged from the head side chamber 26*h* to the tank T.

The meter-in flow passage 44 in the boom driving circuit connects a discharge port of the boom pump 34 and a rod side chamber 24*r* of the boom cylinder 24 with each other so as to supply the hydraulic oil discharged by the boom pump 46 to a head side chamber 24*h*, in other words, so as to operate the boom cylinder 24 toward a direction of lowering the boom 18. The meter-out flow passage 45 connects a head side chamber 24*h* of the boom cylinder 24 and the tank T with each other so as to return the hydraulic oil discharged from the head side chamber 24*h* to the tank T. The regeneration flow passage 43 connects the meter-out flow passage 45 and the meter-in flow passage 44 with each other so as to return a part of the hydraulic oil flowing through the meter-out flow passage 45 to the meter-in flow passage 44 in order to compensate a difference between a meter-in flow rate (flow rate of the hydraulic oil flowing through the meter-in flow passage 44) and a meter-out flow rate (flow rate of the hydraulic oil flowing through the meter-out passage 45) caused by a difference between a cross sectional area of the head side chamber 34*h* and a cross sectional area of the rod side chamber 34*r*.

As described before, though FIG. 1 shows only the flow passages that respectively contract the arm cylinder 26 and the boom cylinder 24 out of flow passages included in the arm driving circuit and the boom driving circuit, these drive circuits simultaneously include flow passages that are not shown, and extend the arm cylinder 26 and the boom cylinder 24. This point holds true for the bucket driving circuit, not shown in FIG. 1.

A back pressure holding valve 48 that holds a back pressure is provided in each of multiple meter-out flow passages including the meter-out flow passages 47 and 45. Moreover, flow rate adjustment valves 54, 55, and 58 are respectively provided for the meter-in flow passage 44, the meter-out flow passage 45, and the regeneration line 43 in the boom driving circuit. Further, a check valve 56 that prevents a backward flow of the hydraulic oil from the meter-in flow passage 44 to the meter-out flow passage 45 is provided in the regeneration line 43.

This apparatus further includes a rotation regeneration accumulator 61, a boom regeneration accumulator 62, a second pump motor line 64, a rotation changeover valve 66, a pressure release changeover valve 68, a rotation regeneration pressure sensor 71, and a boom regeneration pressure sensor 72 as means for regenerating energy held by the upper rotating body 14 and the boom 18.

The rotation regeneration accumulator 61 is a first accumulator connected to the first pump motor line 40, and receives the hydraulic oil discharged from the second pump motor 42 in the second pump operation state, thereby accumulating a pressure.

The boom regeneration accumulator 62 is a second accumulator connected via a regeneration valve 58 to the meter-out flow passage 45 of the boom driving circuit, receives the hydraulic oil discharged from the head side chamber 24*h* of the boom cylinder 24, namely the hydraulic oil at a high pressure pressurized by energy imparted by the boom 18, thereby accumulating the pressure when the boom 18 moves toward a down direction. The regeneration valve 58 is constructed of a flow rate control valve, receives an input of a command signal from the outside, and changes the flow rate of the hydraulic oil introduced from the meter-out flow passage 47 to the boom regeneration accumulator 62.

The second pump motor line 64 connects the boom regeneration accumulator 62 and the first pump motor 41 with each other so that the pressure of the hydraulic oil accumulated in the boom regeneration accumulator 62 is released to the first pump motor 41 in the first motor operation state, thereby enabling the drive of the first pump motor 41. A check valve 65 is provided in the course of the second pump motor line 64, and the check valve 65 prevents a backward flow from the first pump motor 41 to the boom regeneration accumulator 62.

The rotation changeover valve 66 is a line opening/closing changeover valve that opens/closes the first pump motor line 40, and is interposed between the rotation regeneration accumulator 61 and the first pump motor 41 in the first pump motor line 40. This rotation changeover valve 66 is constructed of a solenoid changeover valve having two positions, has an open position that opens the first pump motor line 40 and a closed position that blocks the first pump motor line 40, and is switched between both the positions in accordance with a switching command signal input from the outside. In other words, the rotation changeover valve 66 is opened/closed.

The pressure release changeover valve 68 is provided in an appropriate portion in the second pump motor line 64 so as to open/close the second pump motor line 64, namely a portion between the boom regeneration accumulator 62 and the check valve 65 in FIG. 1. This pressure release changeover valve 68 is constructed of a solenoid changeover valve having two positions as the rotation changeover valve 66, has an open position that opens the second pump motor line 64 and a closed position that blocks the second pump motor line 64, and is switched between both the positions in accordance with a switching command signal input from the outside.

The rotation regeneration pressure sensor 71 is a first pressure sensor that detects a pressure of the hydraulic oil accumulated in the rotation regeneration accumulator 61, which is the first accumulator, and generates and outputs an electric signal corresponding to this pressure, namely, a pressure detection signal. Similarly, the boom regeneration pressure sensor 72 is a second pressure sensor that detects a pressure of the hydraulic oil accumulated in the boom regeneration accumulator 62, which is the second accumulator, and generates and outputs an electric signal corresponding to this pressure, namely, a pressure detection signal.

The apparatus according to this embodiment further includes a boom operation apparatus 74, an arm operation apparatus 76, a bucket operation apparatus 78, a rotation operation apparatus 80, and a controller 100 as shown in FIG. 2.

Each of the operation apparatuses 74, 76, 78, and 80 includes an operation member such as an operation lever that receives an operation for moving the corresponding driving subject, and an operation main unit that generates an operation signal corresponding to an amount of the operation given to the operation lever, and inputs the operation signal to the controller 100. For example, the boom operation apparatus 74 receives an operation for moving the boom 18 toward an up direction or the down direction, and inputs a boom operation signal corresponding to the operation to the controller 100. Moreover, the rotation operation apparatus 80 receives an operation for rotating the upper rotating body 14, and inputs a rotation operation signal corresponding to the operation to the controller 100.

The controller 100 controls the driving of the respective hydraulic actuators based on the operation signals input from the respective operation apparatuses 74, 76, 78, and 80, and the pressure detection signals input from the respective pressure sensors 71 and 72. Specifically, the controller 100 includes a boom control unit 104, an arm control unit 106, a bucket control unit 108, a pump motor control unit 110, a rotation switching control unit 116, a pressure release switching control unit 118, and a circuit switching control unit 120 as shown in FIG. 2.

The boom control unit 104 operates the displacement of the boom pump 34 and a stroke of a control valve, which is included in the boom driving circuit, and is not shown, in order to control the motion of the boom 18, namely, the extension/contraction of the boom cylinder 24 based on the boom operation signal input from the boom operation apparatus 74. In other words, the boom control unit 104 adjusts the displacement of the boom pump 34, and operates the control valve to open in order to move the boom 18 at a speed and in a direction specified by the boom operation signal. Similarly, the arm control unit 106 and the bucket control unit 108 respectively operate the displacements of the arm pump 36 and the bucket pump 38 and strokes of control valves, which are respectively included in the arm driving circuit and the bucket driving circuit, and are not shown, in order to control the motions of the arm 20 and the bucket 200, namely, the extensions/contractions of the arm cylinder 26 and the bucket cylinder 28 based on the arm operation signal and the bucket operation signal respectively input from the arm operation apparatus 76 and the bucket operation apparatus 78.

The pump motor control unit 110 adjusts the displacements of the pump motors 41 and 42, which includes the switching of the operation states of the first and second pump motors 41 and 42. The rotation switching control unit 116 inputs the command signal to the rotation changeover valve 66, thereby switching the position, namely the opening/closing of the rotation changeover valve 66, and, similarly, the pressure release switching control unit 118 inputs the command signal to the pressure release changeover valve 68, thereby switching the position, namely the opening/closing of the pressure release changeover valve 68.

These control units 110, 116, and 118 construct a circuit switching unit which switches the circuit state of the hydraulic circuit shown in FIG. 1 in relation to the rotation driving for the upper rotating body 14, and has multiple modes. The multiple modes include a drive mode, a first regeneration mode, and a second regeneration mode as main modes.

1) Drive Mode

This drive mode is a mode in which the second pump motor 42 is driven by the hydraulic oil discharged by the first pump motor 41, thereby actively rotating the upper rotating body 14, and is appropriate for a constant speed operation or an acceleration operation of the rotation of the upper rotating body 14. This drive mode is realized by the rotation switching control unit 116 switching the rotation changeover valve 66 to the open position, thereby opening the first pump motor line 40, the pressure release switching control unit 118 switching the pressure release changeover valve 68 to the closed position, thereby blocking the second pump motor line 64, and, further, the pump motor control unit 110 bringing the first pump motor 41 into the first pump operation state, and bringing the second pump motor 42 into the second motor operation state. Moreover, if the pressurized oil is accumulated in the rotation regeneration accumulator 61, the drive of the second pump motor 42 is assisted by the rotation regeneration accumulator 61 discharging the hydraulic oil in addition to the first pump motor 41.

2) First Regeneration Mode

This first regeneration mode is a mode in which energy of an inertial rotation of the upper rotating body 14 is regenerated by the second pump motor 42 and the rotation regeneration accumulator 61, and is appropriate for a deceleration operation (braking) of the upper rotating body 14. This first regeneration mode is realized by the rotation switching control unit 116 switching the rotation changeover valve 66 to the closed position, thereby blocking the first pump motor line 40, the pressure release switching control unit 118 switching the pressure release changeover valve 68 to the closed position, thereby blocking the second pump motor line 64, and the pump motor control unit 110 bringing the second pump motor 42 into the second pump operation state. In other words, this first regeneration mode is, in more detail, a mode in which the pressure is accumulated in the rotation regeneration accumulator 61 by the hydraulic oil discharged by the second pump motor 42 in the second pump operation state.

If a load on the prime mover 80 is equal to or more than a certain value, the pump motor control unit 110 brings the first pump motor 41 into the first motor operation state, and the rotation switching control unit 116 switches the rotation changeover valve 66 to the open position, thereby opening the first pump motor line 40. As a result, the first pump motor 41 operates as a motor by the hydraulic oil discharged from the second pump motor 42 (the rotation regeneration accumulator 61 if the pressure is accumulated in the rotation regeneration accumulator 61), in other words, generates power by means of the energy of the hydraulic oil, thereby assisting the prime mover 30.

3) Second Regeneration Mode

This second regeneration mode is a mode in which the pressure accumulated in the boom regeneration accumulator 62 is released toward the first pump motor 41 to operate the first pump motor 41 as the motor, thereby assisting the prime mover 30, and is a mode that can be carried out if the upper rotating body 14 is not rotating. This second regeneration mode is realized by the rotation switching control unit 116 switching the rotation changeover valve 66 to the closed position, the pressure release switching control unit 118 switching the pressure release changeover valve 68 to the open position, and the pump motor control unit 110 bringing the first pump motor 41 into the first motor operation state.

The circuit switching control unit 120 selects the mode to be carried out out of the multiple modes based on the operation given to the rotation operation apparatus 80, namely, the operation relating to the rotation driving for the upper rotating body 14, which is the first driving subject, and inputs commands to the respective control units 110, 116, 118 so as to realize this mode. The circuit switching control unit 120 according to this embodiment selects the drive mode while such a condition that an operation of carrying out the constant speed operation or acceleration for the rotation of the upper rotating body 14 is given to the rotation operation apparatus 80 is required as a necessary condition, selects the first regeneration mode while such a condition that an operation of carrying out the deceleration (braking) for the rotation of the upper rotating body 14 is given to the rotation operation apparatus 80 is required as a necessary condition, and selects the second regeneration mode while such a condition that an operation for the upper rotating body 14 is not given to the rotation operation apparatus 80 is required as a necessary condition. According to this embodiment, a description will later be given of details of conditions for selecting the respective modes other than the respective necessary conditions.

Figure 3:
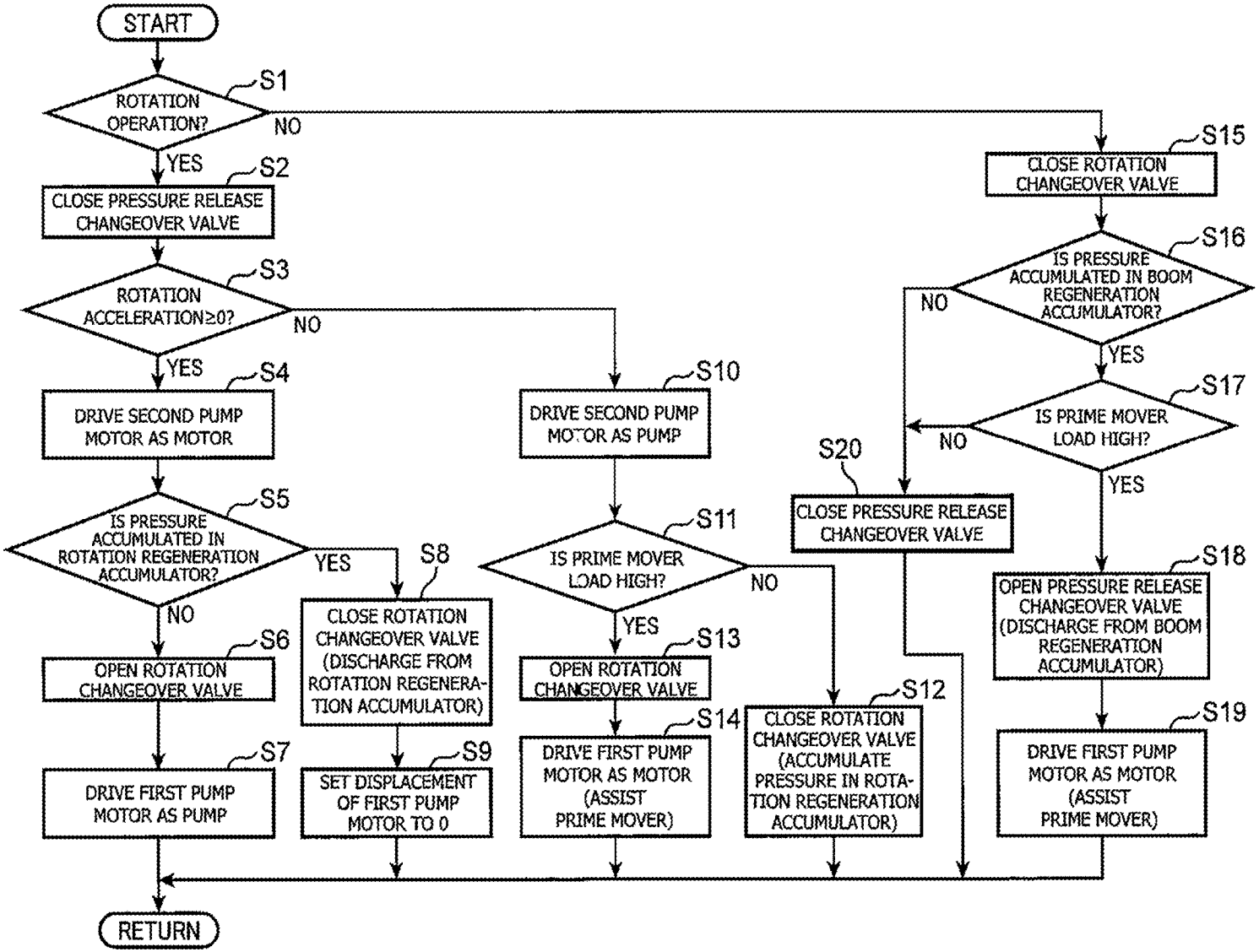
FIG. 3 is a flowchart of a control operation of the controller according to the first embodiment.

FIG. 3 shows a calculation control operation actually carried out by the controller 100 for the rotation driving and the regeneration for the upper rotating body 14.

The circuit switching control unit 120 of the controller 100 first determines whether the rotation operation is given or not, in other words, some operation is given to the operation lever of the rotation operation apparatus 80 (Step S1). Any of the modes selected if the rotation operation is given (YES in Step S1) require the blocking of the second pump motor line 64, the circuit switching control unit 120 thus causes the pressure release switching control unit 118 to output the command signal so as to switch the pressure release changeover valve 68 to the closed position (Step S2).

If the rotation operation is the operation of rotating the upper rotating body 14 at a constant speed, or accelerating the rotation (YES in Step S3), the circuit switching control unit 120 carries out an instruction of realizing the drive mode in principle. Specifically, the circuit switching control unit 120 carries out an instruction of bringing the second pump motor 42 into the second motor operation state so as to drive the second motor 42 as a motor (Step S4), switching the rotation changeover valve 66 to the open position so as to open the first pump motor line 40 (Step S6), and further switching the first pump motor 41 to the first pump operation state so as to drive the first pump motor 41 as a pump by the prime mover 30 (Step S7). In this drive mode, the first pump motor 41 driven by the prime mover 30 sucks the hydraulic oil in the tank, and supplies hydraulic oil via the first pump motor line 40 to the second pump motor 42, and the second pump motor 42, which receives this supply, operates as the motor, thereby rotating the upper rotating body 14.

It should be noted that if the pressure is sufficiently accumulated in the rotation regeneration accumulator 61 (YES in Step S5), in other words, the pressure in the rotation regeneration accumulator 61 detected by the rotation regeneration pressure sensor 71 is equal to or more than a certain value, the circuit switching control unit 120 exceptionally carries out an instruction of switching the rotation changeover valve 66 to the closed position so as to carry out an assist mode of driving second pump motor 42 by means of the pressure in the rotation regeneration accumulator 61, in other words, discharging the hydraulic oil from the rotation regeneration accumulator 61 to the second pump motor 42 (Step S8). In this case, the displacement of the first pump motor 41 is preferably set to 0 (Step S9).

The pump motor control unit 110 adjusts the displacements of the first and second pump motors 41 and 42 in the drive mode. Control on which this adjustment of the displacements is based may appropriately be selected. For example, after the displacement of the first pump motor 41 is adjusted so that a pressure (pump pressure) of the hydraulic oil discharged by the first pump motor 41 is controlled to be constant, the displacement of the second pump motor 42 is adjusted so that an output torque of the second pump motor 42 is controlled to be constant.

On the other hand, if the rotation operation is an operation of decelerating the rotation of the upper rotating body 14 (NO in Step S3), the circuit switching control unit 120 carries out an instruction of realizing the first regeneration mode in principle. Specifically, the circuit switching control unit 120 carries out an instruction of bringing the second pump motor 42 into the second pump operation state so as to drive the second pump motor 42 as a pump (Step S10), and switching the rotation changeover valve 66 to the closed position so as to block the first pump motor line 40 (Step S12). In this mode, the second pump motor 42 carries out the pump operation of sucking and discharging the hydraulic oil in the tank T by means of the energy of the inertial rotation of the upper rotating body 14, and the rotation regeneration accumulator 61 receives the discharged hydraulic oil, thereby accumulating the pressure.

It should be noted that the load on the prime mover 30 is equal to or more than the certain value (YES in Step S11), the circuit switching control unit 120 carries out an instruction of switching the rotation changeover valve 66 to the open position (Step S13), and switching the first pump motor 41 to the first motor operation state (Step S14) in order to use the hydraulic oil discharged by the second pump motor 42 to assist the prime mover 30. In this mode, the hydraulic oil discharged by the second pump motor 42 is supplied to the first pump motor 41, thereby operating the first pump motor 41 as the motor, in other words, causing the first pump motor 41 to generate power, and the prime mover 80 is assisted by means of the power.

If the rotation operation is not being carried out, in other words, the operation is not given to the rotation detector 80 (NO in Step S1), the circuit switching control unit 120 carries out an instruction of switching the rotation changeover valve 66 to the closed position in order to block the first pump motor line 40 (Step S15). Further, if the predetermined regeneration conditions are satisfied, specifically, both the condition that the boom regeneration accumulator 62 has sufficiently accumulated the pressure (condition that the pressure detected by the boom regeneration pressure sensor 61 is equal to or more than a certain value) and the condition that the load on the prime mover 30 is equal to or more than the certain value are satisfied (YES both in Steps S16 and S17), the circuit switching control unit 120 carries out the instruction of switching the pressure release changeover valve 68 to the open position, thereby opening the second pump motor line 64 and the instruction of switching the first pump motor 41 to the first motor operation state in order to realize the second regeneration mode (Steps S18 and S19). In this second regeneration mode, the pressure of the hydraulic oil accumulated in the boom regeneration accumulator 62 is released to the first pump motor 41 in the first motor operation state, and the first pump motor 41 consequently operates as the motor, thereby assisting the prime mover 30.

It should be noted that if the predetermined regeneration condition is not satisfied, in other words, the pressure is not sufficiently accumulated in the boom regeneration accumulator 62, or the load on the prime mover 30 is less than the certain value (NO in at least either one of Steps S16 and S17), the circuit switching control unit 120 carries out the instruction of switching the pressure release changeover valve 68 to the closed position in order to carry out a normal work mode (Step S20).

In this normal work mode, when the boom cylinder 24 contracts so as to move the boom 18 toward the down direction, the hydraulic oil at a high pressure is discharged from the head side chamber 24*h* of the boom cylinder 24 by energy of the gravity acting on the boom 18, and at least a part of the hydraulic oil is introduced into the boom regeneration accumulator 62. The pressure is accumulated in the boom regeneration accumulator 62 in this way, and energy thereof is supplied for the assist for the prime mover 30 via the first pump motor 41 in the second regeneration mode.

With the apparatus described before, the hydraulic oil accumulated in the boom regeneration accumulator 62 can be introduced via the second pump motor line 64 into the first pump motor 41 for the rotation driving, the energy can be regenerated from any of the upper rotating body 14, which is the first driving subject, and the boom 18, which is the second driving subject, without employing an expensive pump motor for the boom cylinder 24, which is a regeneration subject hydraulic actuator. Particularly, if the multiple hydraulic pumps are connected to the common output shaft 32 as shown in FIG. 1, as the number of the multiple hydraulic pumps increases, a so-called drag loss, namely, an energy loss caused by unused pump motors dragged by the used pump motor increases, and an advantage brought about by the reduction in the number of the pump motors is thus large.

According to the first embodiment, the rotation changeover valve 66 is switched to the closed position in the second regeneration mode and the normal work mode to hold the pressure in the rotation regeneration accumulator 61, which is the first accumulator, thereby providing a function of a pressure holding valve that prevents the pressure release from the rotation regeneration accumulator 61 to the first pump motor 41, but the function required for this pressure holding valve can be realized by a valve other than the rotation changeover valve 66.

Figure 4:
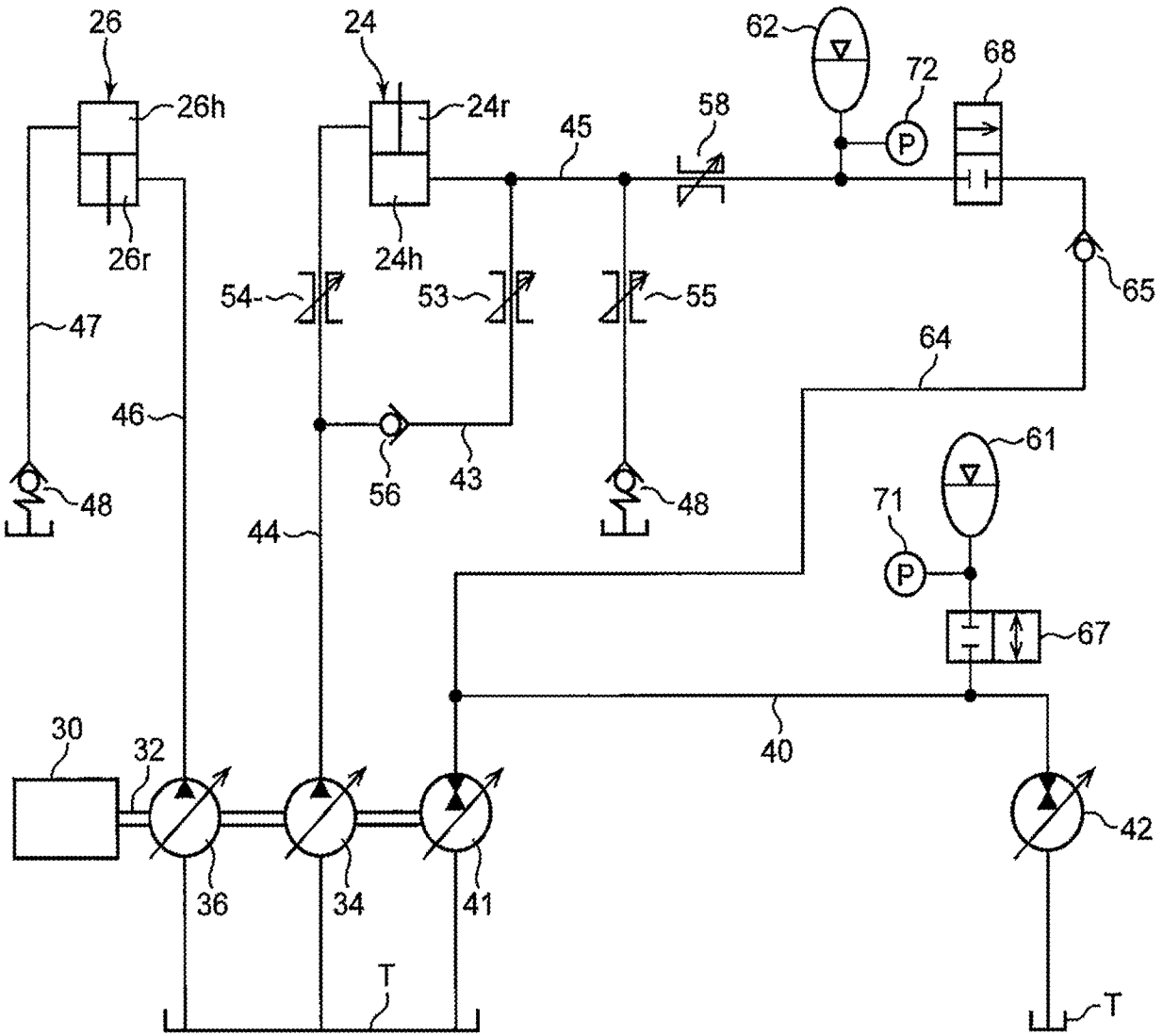
FIG. 4 is a circuit diagram of the hydraulic driving apparatus according to a second embodiment of the present invention.

An example thereof is shown in FIG. 4 as a second embodiment. The apparatus according to the second embodiment includes an accumulator opening/closing changeover valve 67 in place of the rotation changeover valve 66. This accumulator opening/closing changeover valve 67 is provided at a position between the first pump motor line 40 and the rotation regeneration accumulator 61, which is the first accumulator. The accumulator opening/closing changeover valve 67 is constructed of a solenoid changeover valve having two positions as the rotation changeover valve 66, and has an open position of causing the first pump motor line 40 and the rotation regeneration accumulator 61 to communicate with each other, and a blocked position of blocking them from each other. Moreover, a rotation regeneration pressure sensor 71 according to the second embodiment is provided at a position closer to the rotation regeneration accumulator 61 than the accumulator opening/closing changeover valve 67.

Figure 5:
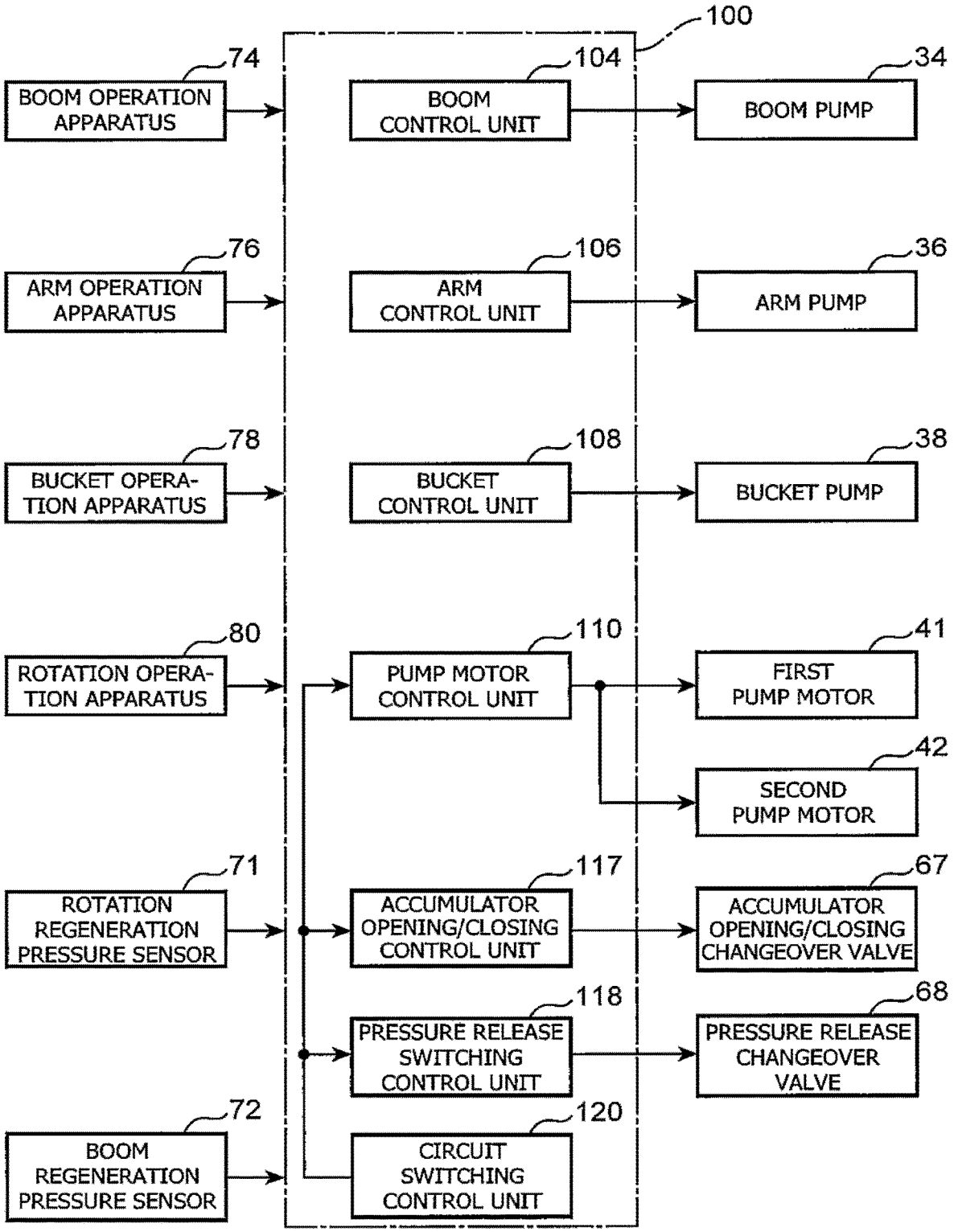
FIG. 5 is a block diagram of the functional configuration of the controller included in the hydraulic driving apparatus according to the second embodiment.
Figure 6:
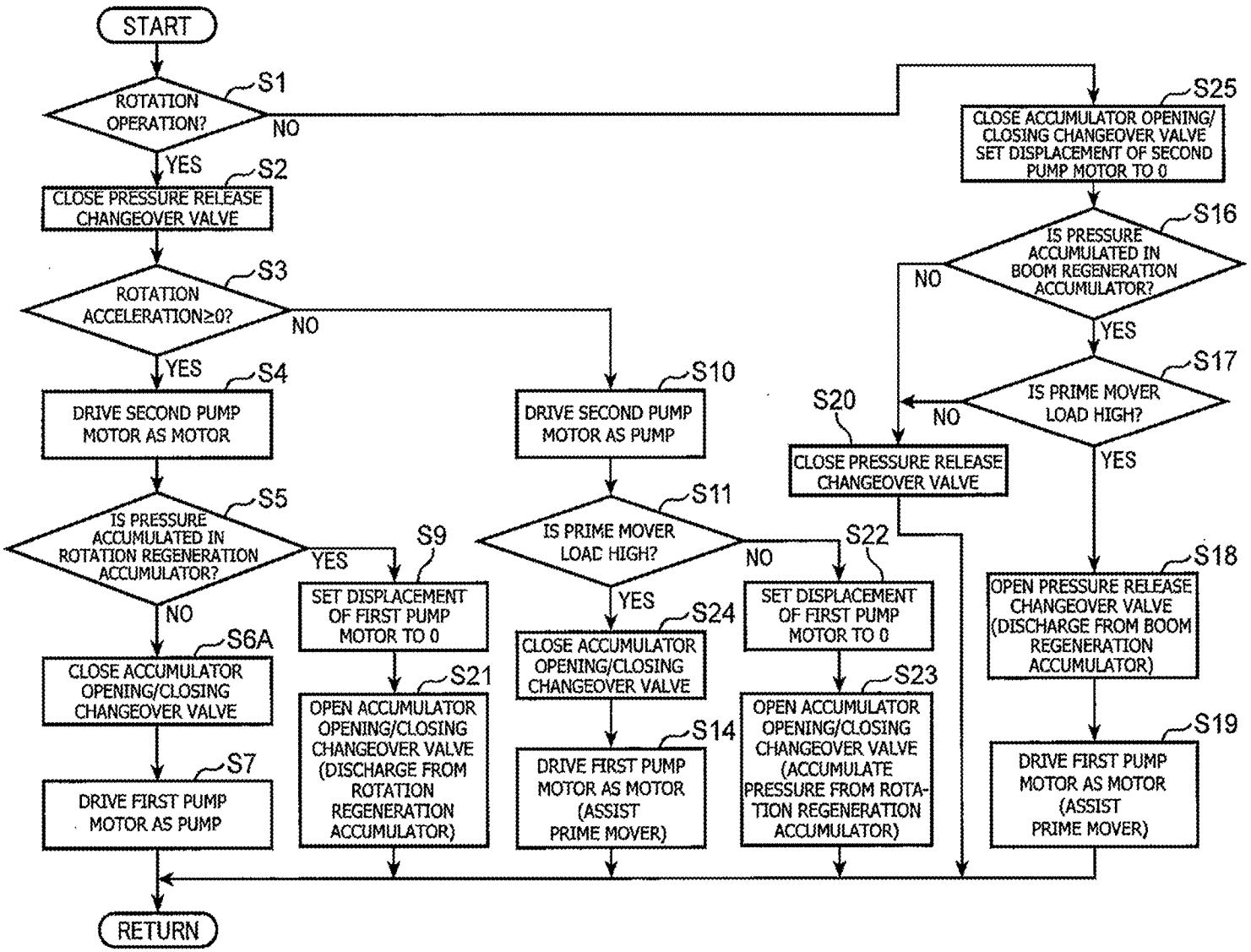
FIG. 6 is a flowchart of the control operation of the controller according to the second embodiment.

FIG. 5 shows the controller 100 provided for the apparatus according to the second embodiment. The controller 100 includes an accumulator opening/closing control unit 117 that switches the position of the accumulator opening/closing changeover valve 67 in place of the rotation switching control unit 116. The accumulator opening/closing control unit 117 can switch the rotation regeneration accumulator opening/closing changeover valve 67 to the open position, thereby enabling introduction of the hydraulic oil discharged by the second pump motor 42 in the second pump operation state into the rotation regeneration accumulator 61, and can switch the accumulator opening/closing changeover valve 67 to the closed position, thereby holding the pressure in the rotation regeneration accumulator 61, and surely blocking the inflow of the hydraulic oil, which is supplied from the boom regeneration accumulator 62 to the first pump motor 41, to the rotation regeneration accumulator side.

The controller 100 according to the second embodiment includes the circuit switching control unit 120 as the controller 100 according to the first embodiment, and the circuit switching control unit 120 carries out the control as in the first embodiment. It should be noted that the first pump motor line 40 is in a state in which the first pump motor line 40 that mutually connects the first and second pump motors 41 and 42 with each other is always communicating in the circuit according to the second embodiment, and an operation carried out by the controller 100 is different from the operation according to the first embodiment in the following points (a) to (c).

(a) If the operation for the constant speed rotation or the rotation acceleration is being carried out (YES in Step S3), and the pressure is not sufficiently accumulated in the rotation regeneration accumulator 61 (NO in Step S5), the circuit switching control unit 120 instructs the accumulator opening/closing control unit 117 to switch the position of the accumulator opening/closing changeover valve 67 to the closed position (Step S6A). As a result, the hydraulic oil discharged from the first pump motor 41 is supplied to the second pump motor 42 without being introduced into the rotation regeneration accumulator 61. On the other hand, if the pressure is sufficiently accumulated in the rotation regeneration accumulator 61 (YES in Step S5), the circuit switching control unit 120 instructs the accumulator opening/closing control unit 117 to set the displacement of the first pump motor 41 to 0 (Step S9) as well as to switch the position of the accumulator opening/closing changeover valve 67 to the open position (Step S21). As a result, the hydraulic oil can be supplied from the rotation regeneration accumulator 61 to the second pump motor 42.

(b) If the operation for the rotation deceleration is being carried out (NO in Step S3), and the load on the prime mover 30 is less than the certain value (NO in Step S11), the circuit switching control unit 120 carries out an instruction of setting the displacement of the first pump motor 41 to 0 (Step S22), and switching the accumulator opening/closing changeover valve 67 to the open position (Step S23). As a result, the hydraulic oil discharged from the second pump motor 42 can be introduced into the rotation regeneration accumulator 61. On the other hand, if the load on the prime mover 30 is equal to or more than the certain value (YES in Step S11), the circuit switching control unit 120 carries out an instruction of switching the accumulator opening/closing changeover valve 67 to the closed position (Step S24). As a result, the hydraulic oil discharged from the second pump motor 42 can be supplied for the drive of the first pump motor 41 as the motor without being introduced into the rotation regeneration accumulator 61.

(c) If the rotation is not being carried out (NO in Step S1), the circuit switching control unit 120 carries out an instruction of switching the accumulator opening/closing changeover valve 67 to the closed position, and setting the displacement (geometric displacement) of the second pump motor 42 to 0, thereby bringing the second pump motor 42 into the substantially blocked state in order to surely prevent the hydraulic oil supplied from the boom regeneration accumulator 62 to the first pump motor 41 from being introduced into the rotation regeneration accumulator 61, and from flowing via the second pump motor 42 to the tank T (Step S25).

Figure 7:
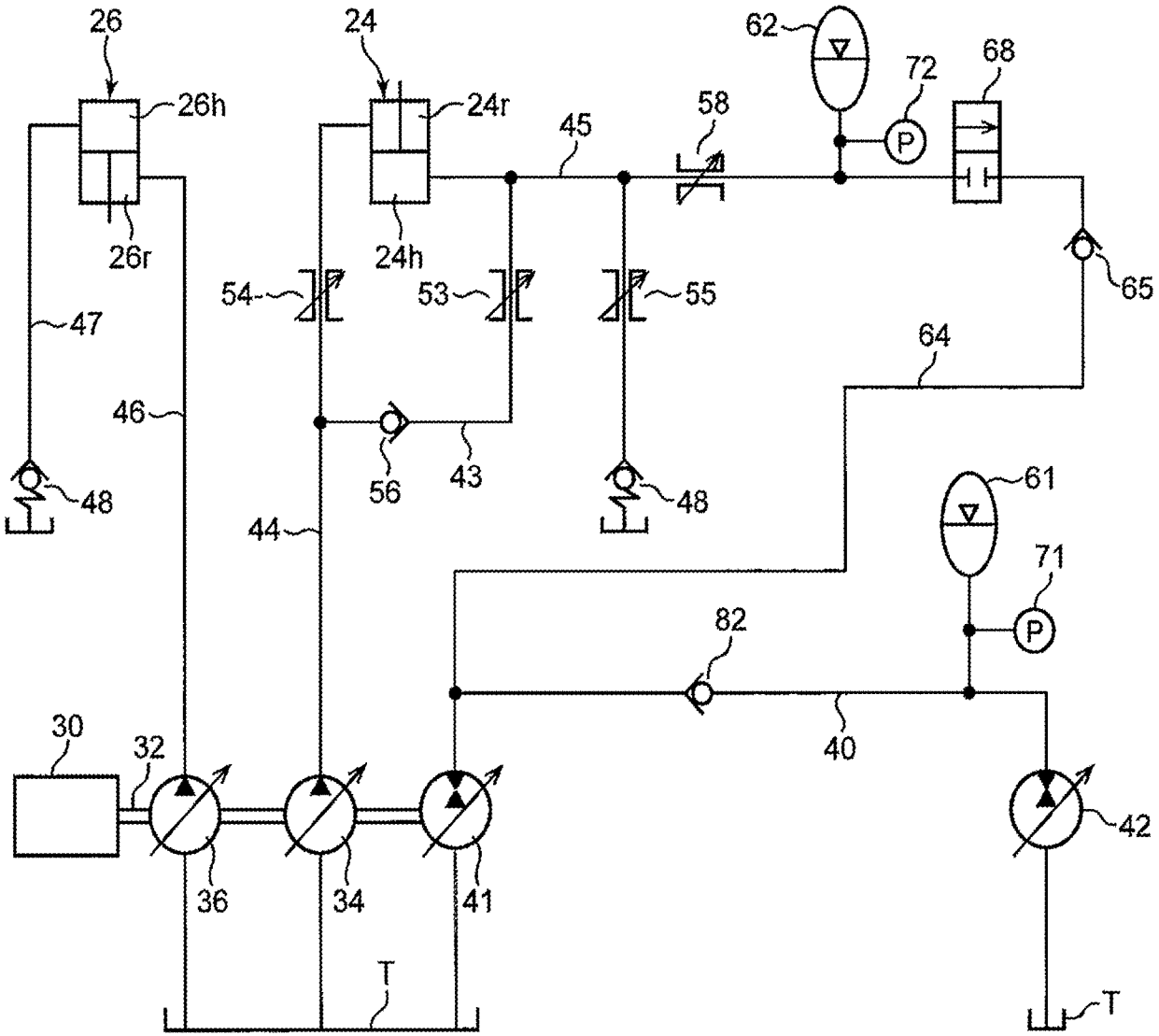
FIG. 7 is a circuit diagram of the hydraulic driving apparatus according to a third embodiment of the present invention.

Though either one of the rotation changeover valve 66 and the accumulator opening/closing changeover valve 67 has the closed position of completely blocking the first pump motor 41 and the rotation regeneration accumulator 61 from each other, an operation pressure of the rotation regeneration accumulator 61 is generally sufficiently higher than an operation pressure of the boom regeneration accumulator 62, and even if the pressure holding valve does not have the closed position, the hydraulic oil can be blocked from flowing from the boom regeneration accumulator 62 into the rotation regeneration accumulator 61. The pressure holding valve may be, for example, a check valve 82 as shown in FIG. 7 as a third embodiment. This check valve 82 is provided between the rotation regeneration accumulator 61 and the first pump motor 41 in the first pump motor line 40, and has a function of permitting the flow of the hydraulic oil from the first pump motor 41 toward the second pump motor 42, and blocking the flow of the hydraulic oil from the rotation regeneration accumulator 61 toward the first pump motor 41, thereby holding the pressure in the rotation regeneration accumulator 61.

According to the third embodiment, though the regeneration by supplying the hydraulic oil from the second pump motor 42 or the rotation regeneration accumulator 61 to the first pump motor 41, thereby driving the first pump motor 41 as the motor is not carried out, the regeneration of introducing the hydraulic oil discharged from the second pump motor 42 into the rotation regeneration accumulator 61 is available.

The first driving subject to which the second pump motor is coupled and the second driving subject to which the regeneration subject hydraulic actuator is coupled according to the present invention are not limited respectively to the upper rotating body 14 and the boom 18.

Figure 8:
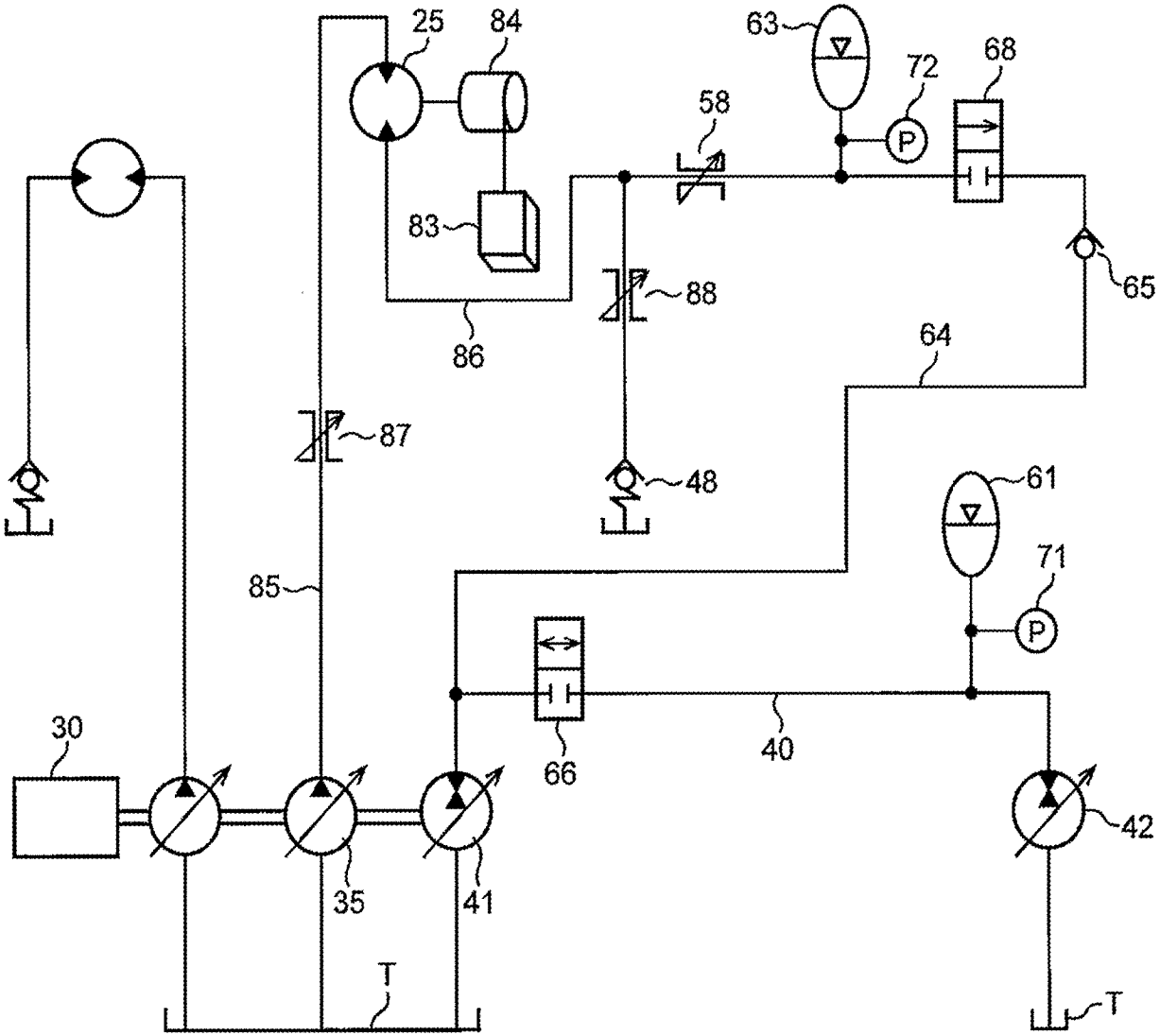
FIG. 8 is a circuit diagram of the hydraulic driving apparatus according to a fourth embodiment of the present invention.

FIG. 8 shows the hydraulic driving apparatus according to a fourth embodiment. This apparatus includes a winch motor 25 that rotates a winch drum 84 for lifting up/down a suspended load 83 in a crane as the regeneration subject hydraulic actuator in place of the boom cylinder 24, and includes a winch pump 35 in place of the boom pump 34. The winch motor 25 is constructed of a hydraulic motor, is connected via a mater-in flow passage 85 including a flow rate control valve 87 to the winch pump 35, and is connected via a meter-out flow passage 88 including a flow rate control valve 87 to the tank T.

Also in this apparatus, the energy held by the second driving subject, namely, energy of the winch drum 84 rotated by the gravity acting on the suspended load 83 can be accumulated by connecting a winch regeneration accumulator 63, which is the second accumulator, to an appropriate position of, for example, the meter-out flow passage 88, and introducing the hydraulic oil at a high pressure, which is discharged from the winch motor 25 to the meter-out flow passage 88, into the winch regeneration accumulator 63 when the suspended load 83 is lifted down, in other words, during wind-down driving. Then, the energy can be regenerated by releasing the pressure accumulated in the winch regeneration accumulator 63 via the second pump motor line 64 and the pressure release changeover valve 68 toward the first pump motor 41, thereby operating the first pump motor 41 as the motor as in the first embodiment.

Figure 9:
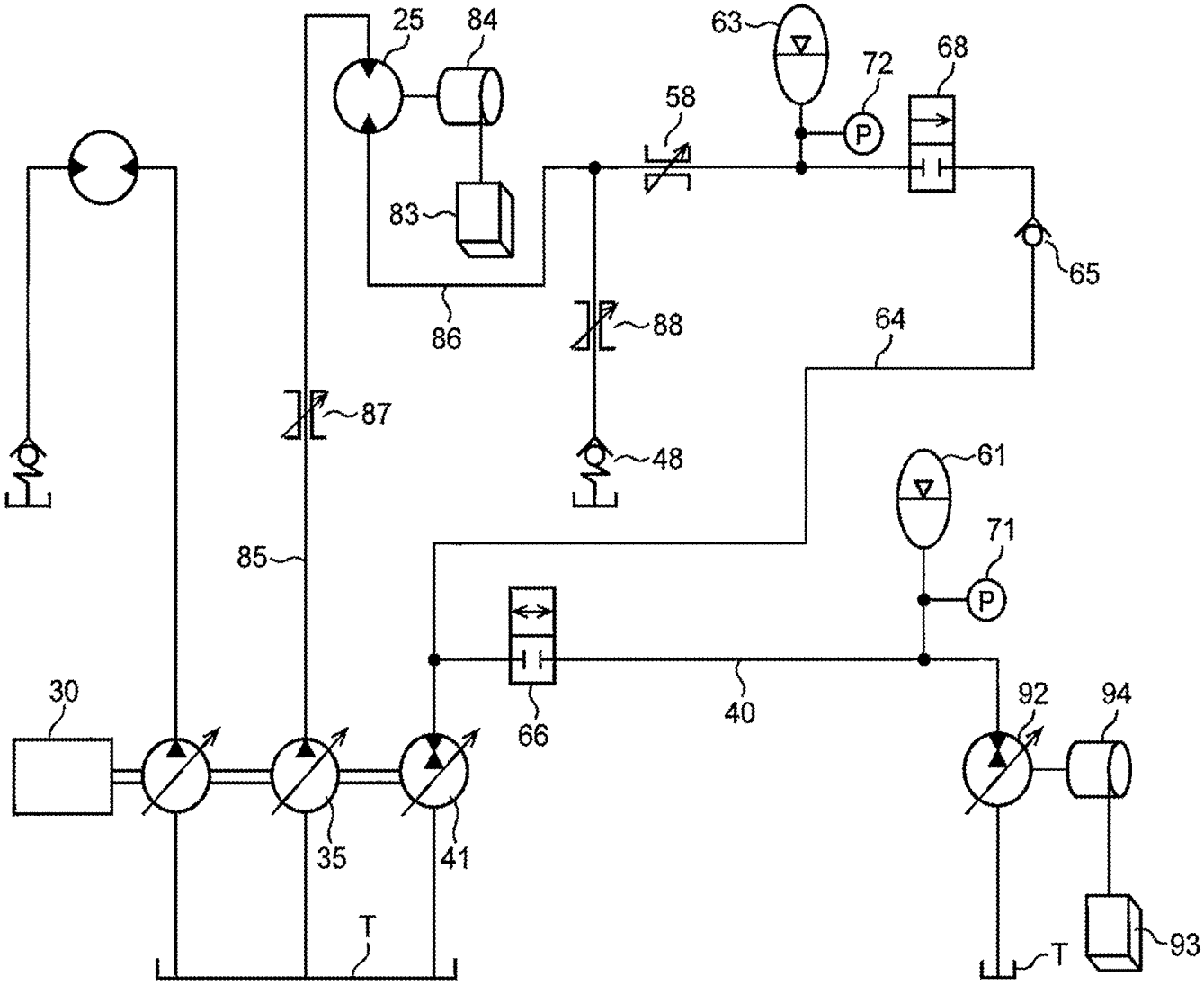
FIG. 9 is a circuit diagram of the hydraulic driving apparatus according to a fifth embodiment of the present invention.

FIG. 9 shows the hydraulic driving apparatus according to a fifth embodiment. This apparatus includes a winch driving second pump motor 92 that drives a winch drum 94 independently of the winch drum 84 in place of the second pump motor 42 for the rotation driving according to the fourth embodiment. The second pump motor 92 can also be switched between the second pump operation state and the second motor operation state as the second pump motor 42 according to the first embodiment, receives a supply of the hydraulic oil from the first pump motor 41 in the second motor operation state, thereby driving the winch drum 94 in a wind-up direction, for example, and operates as a pump by rotation energy of the winch drum 94 rotating in the wind-down direction in the second pump operation state. In other words, the second pump motor 92 sucks and discharges the hydraulic oil in the tank T.

Also in the fifth embodiment, the energy accumulated in the winch regeneration accumulator 63 can be regenerated by switching the pressure release changeover valve 68 to the open position, thereby releasing the pressure from the winch regeneration accumulator 63 to the first pump motor 41 when the operation relating to the driving of the winch drum 94 by the second pump motor 42 is not being carried out.

Though the multiple hydraulic pumps are serially connected to the common output shaft 32 in the respective embodiments, the multiple hydraulic pumps may be connected in parallel to a common prime mover via a power device. Alternatively, the multiple hydraulic pumps may be distributed and connected to multiple prime movers.

According to the present invention, it is not excluded to further include a charge circuit or a low pressure accumulator that supplies pressurized oil to the second pump motor in order to supplement pumping power of the second pump motor in the second pump operation state. For example, the charge pump or the low-pressure accumulator may be connected to the low-pressure line between the second pump motor 42 and the tank T shown in FIG. 1.

As described before, there is provided a hydraulic driving apparatus capable of driving multiple driving subjects in a work machine, and regenerating energy thereof by a simple and low-cost configuration.

Provided is a hydraulic driving apparatus for respectively driving a first driving subject and a second driving subject included in a work machine by means of a hydraulic pressure, including a first pump motor that can be switched between a first pump operation state of being driven by a prime mover, thereby sucking hydraulic oil for driving the first driving subject from a tank, and discharging the hydraulic oil and a first motor operation state of receiving a supply of the hydraulic oil, thereby generating power, a second pump motor that is coupled to the first driving subject, and can be switched between a second motor operation state of receiving a supply of the hydraulic oil discharged from the first pump motor in the first pump operation state, thereby moving the first driving subject and a second pump operation state of receiving a supply of energy held by the first driving subject, thereby operating so as to suck the hydraulic oil from the tank, and discharge the hydraulic oil, a first pump motor line that connects the first pump motor and the second pump motor with each other so that the hydraulic oil can be supplied from the first pump motor to the second pump motor, a first accumulator that is connected to the first pump motor line, and receives the hydraulic oil discharged from the second pump motor in the second pump operation state, thereby accumulating a pressure, a pressure holding valve that is interposed between the first accumulator and the first pump motor, and preventing a pressure release from the first accumulator to the first pump motor so as to hold the pressure in the first accumulator, a regeneration subject hydraulic actuator that is coupled to the second driving subject, and receives a supply of the hydraulic oil, thereby moving the second driving subject, a hydraulic pump that sucks the hydraulic oil to be supplied to the regeneration subject hydraulic actuator from the tank, and discharges the hydraulic oil, a second accumulator that receives the hydraulic oil pressurized by means of energy held by the second driving subject, and discharged from the regeneration subject hydraulic actuator, thereby accumulating a pressure, a second pump motor line that connects the second accumulator to the first pump motor so that the pressure of the hydraulic oil accumulated in the second accumulator is released to the first pump motor in the first motor operation state, thereby enabling the drive of the first pump motor, and a pressure release changeover valve that can be switched between an open state of opening the second pump motor line, thereby enabling the pressure release from the second accumulator to the first pump motor and a closed state of blocking the second pump motor line, thereby blocking the pressure release.

With this apparatus, the driving of the first pump motor by the hydraulic oil released from the second accumulator can be carried out in addition to the driving of the second pump motor by the hydraulic oil discharged by the first pump motor or the hydraulic oil released from the first accumulator and the pressure accumulation in the first accumulator by the hydraulic oil discharged by the second pump motor through a combination of the switching of the first pump motor between the first pump operation state and the first motor operation state, the switching of the second pump motor between the first pump operation state and the first motor operation state, and the switching of the pressure release valve between the open state and the closed state. In other words, the energy can be regenerated in any one of the regeneration subject hydraulic actuator and the first hydraulic actuator with the simple and low-cost configuration that does not require an expensive pump motor for the regeneration subject hydraulic actuator, which is different from conventional apparatuses. Moreover, the drag loss, namely, the energy loss caused by unused pump motors dragged by the used pump motor can be suppressed compared with such a configuration that the multiple pump motors are connected to a common prime mover.

Specifically, the pressure release changeover valve is brought into the closed state, the first pump motor is brought into the first pump operation state, and the second pump motor is brought into the second motor operation state to use the hydraulic oil discharged by the first pump motor to drive the second pump motor, thereby enabling the movement of the first driving subject coupled to the second pump motor in this apparatus. On the other hand, the pressure release changeover valve is brought into the closed state, and the second pump motor is brought into the second pump operation state to use the energy given by the regeneration subject hydraulic actuator to the second pump motor to operate the second pump motor as the pump, thereby introducing the hydraulic oil discharged by the second pump motor into the first accumulator, in other words, regenerating the energy by means of the pressure accumulation in the first accumulator. Further, the pressure release changeover valve is brought into the open state, and the first pump motor is brought into the first motor operation state, thereby enabling the operation of the first pump motor as a motor by means of the pressure release from the second accumulator to the first pump motor, in other words, the regeneration of the energy held by the regeneration subject hydraulic actuator.

In this apparatus, the pressure holding valve is preferably a line opening/closing changeover valve that is provided between the first accumulator and the first pump motor in the first pump motor line, and can be switched between an open state of bringing the first pump motor line in a communication state and a closed state of blocking the first pump motor line. The first pump motor can also be driven by means of the pressure accumulated in the first accumulator by bringing the line opening/closing valve into the open state, and bringing the first pump motor into the first motor operation state, and, further, the first pump motor can be driven by the hydraulic oil discharged by the second pump motor by bringing the second pump motor into the second pump operation state. On the other hand, inflow of the hydraulic oil, which is supplied from the second accumulator to the first pump motor, into the first accumulator side can more surely be blocked by bringing the opening/closing changeover valve into the closed state.

Alternatively, the pressure holding valve may be an accumulator opening/closing changeover valve that is provided at a position between the first pump motor line and the first accumulator, and can be switched between an open state of causing the first pump motor line and the first accumulator to communicate with each other and a blocked state of blocking the first pump motor line and the first accumulator from each other. The hydraulic oil discharged from the second pump motor in the second pump operation state can be introduced into the first accumulator by bringing the accumulator opening/closing changeover valve into the open state, and the hydraulic oil can be supplied from the second pump motor in the second pump operation state to the first pump motor in the first motor operation state by bringing the accumulator opening/closing changeover valve into the closed state, thereby enabling assist of the prime mover coupled to the first pump motor.

If the pressure holding valve is the accumulator opening/closing changeover valve, a form in which the first pump motor and the second pump motor always communicate with each other is included. However, even in this form, the inflow of the hydraulic oil, which is supplied from the second accumulator to the first pump motor, into the second pump motor side can be blocked, for example, by setting the displacement (geometric displacement) of the second pump motor to 0, thereby bringing the second motor into a substantially blocked state.

Moreover, if an operation pressure of the first accumulator is higher than an operation pressure of the second accumulator, even if the pressure holding valve does not have the function of completely blocking the first pump motor line, the inflow of the hydraulic oil from the second accumulator into the first accumulator can be blocked. In this case, the pressure holding valve may be, for example, a check valve that is provided between the first accumulator and the first pump motor in the first pump motor line, permits a flow of the hydraulic oil from the first pump motor to the second pump motor, and blocks a flow of the hydraulic oil from the first accumulator to the first pump motor.

The hydraulic driving apparatus further includes a circuit switching unit that has a plurality of modes, and the plurality of modes preferably include a drive mode of bringing the pressure release changeover valve into the closed state, bringing the first pump motor into the first pump operation state, and bringing the second pump motor into the second motor operation state, thereby enabling the second pump motor to be driven by the hydraulic oil discharged by the first pump motor, a first regeneration mode of bringing the pressure release changeover valve into the closed state, and bringing the second pump motor into the second pump operation state, thereby enabling the hydraulic oil discharged by the second pump motor to be introduced into the first accumulator, and a second regeneration mode of bringing the pressure release changeover valve into the open state, and bringing the first pump motor into the first motor operation state, thereby enabling the first pump motor to operate as a motor by means of the pressure release from the second accumulator to the first pump motor. With the circuit switching unit, the hydraulic driving apparatus can have a function of automatically switching the circuit state.

For example, if the pressure holding valve is the line opening/closing changeover valve, the circuit switching unit preferably brings the line opening/closing changeover valve into the open state in the drive mode, and brings the line opening/closing changeover valve into the closed state in the second regeneration mode. The circuit switching unit may bring the line opening/closing changeover valve into the open state or the closed state in the first regeneration mode. If the line opening/closing changeover valve is brought into the open state, and the first pump motor is brought into the first motor operation state in the first regeneration mode, the hydraulic oil released by the first accumulator and the hydraulic oil discharged by the second pump motor can also be supplied to the first pump motor, thereby enabling the drive of the first pump motor.

On the other hand, if the pressure holding valve is the accumulator opening/closing changeover valve, the circuit switching unit preferably brings the accumulator opening/closing changeover valve into the open state in the first regeneration mode, and preferably brings the accumulator opening/closing changeover valve into the closed state in the second regeneration mode. The circuit switching unit may bring the accumulator opening/closing changeover valve into the open state or the closed state in the drive mode.

The apparatus according to the present invention more preferably includes, in addition to the circuit switching unit, an operation apparatus that receives an operation for a command for the driving of the first driving subject, and a circuit switching control unit that switches the mode of the circuit switching unit based on the operation given to the operation apparatus. Specifically, the circuit switching control unit preferably switches the circuit switching unit to the drive mode while such a condition that an operation of driving the first driving subject at a constant speed or an operation of accelerating the first driving subject is given to the operation apparatus is required as a necessary condition, switches the circuit switching unit to the first regeneration mode while such a condition that an operation of decelerating the first driving subject is given to the operation apparatus is required as a necessary condition, and switches the circuit switching unit to the second regeneration mode while such a condition that the operation relating to the driving of the first driving subject is not given to the operation apparatus is required as a necessary condition.

The necessary condition for switching to the second regeneration mode preferably further includes such a condition that the load on the prime mover that drives the first pump motor is equal to or more than a certain value. If this condition is satisfied, the prime mover can be assisted via the first pump motor by switching the circuit switching unit to the second regeneration mode, in other words, bringing the first pump motor into the first motor operation state to drive the first pump motor by means of the pressure accumulated in the second accumulator.

The invention claimed is:

1. A hydraulic driving apparatus for respectively driving a first driving subject and a second driving subject included in a work machine by way of hydraulic pressure, comprising:

a first pump motor that can be switched between a first pump operation state of being driven by a prime mover, thereby sucking hydraulic oil for driving the first driving subject from a tank, and discharging the hydraulic oil and a first motor operation state of receiving a supply of the hydraulic oil, thereby generating power;

a second pump motor that is coupled to the first driving subject, and can be switched between a second motor operation state of receiving a supply of the hydraulic oil discharged from the first pump motor in the first pump operation state, thereby moving the first driving subject and a second pump operation state of receiving a supply of energy held by the first driving subject, thereby operating so as to suck the hydraulic oil from the tank, and discharge the hydraulic oil;

a first pump motor line that connects the first pump motor and the second pump motor with each oilier so that the hydraulic oil can be supplied from the first pump motor to the second pump motor;

a first accumulator that is connected to the first pump motor line, and receives the hydraulic oil discharged from the second pump motor in the second pump operation state, thereby accumulating a pressure;

a pressure holding valve that is interposed between the first accumulator and the first pump motor, and preventing a pressure release from the first accumulator to the first pump motor so as to hold the pressure in the first accumulator;

a regeneration subject hydraulic actuator that is coupled to the second driving subject, and receives a supply of the hydraulic oil, thereby moving the second driving subject;

a hydraulic pump that sucks the hydraulic oil to be supplied to the regeneration subject hydraulic actuator from the tank, and discharges the hydraulic oil;

a second accumulator that receives the hydraulic oil pressurized by way of energy held by the second driving subject, and discharged from the regeneration subject hydraulic actuator, thereby accumulating a pressure;

a second pump motor line that connects the second accumulator to the first pump motor so that the pressure of the hydraulic oil accumulated in the second accumulator is released to the first pump motor in the first motor operation state, thereby enabling the drive of the first pump motor;

a pressure release changeover valve that can be switched between an open state of opening the second pump motor line, thereby enabling the pressure release from the second accumulator to the first pump motor and a closed state of blocking the second pump motor line, thereby blocking the pressure release;

a circuit switching unit that has a plurality of modes, wherein the plurality of modes include:

a drive mode of bringing the pressure release changeover valve into the closed state, bringing the first pump motor into the first pump operation state, and bringing the second pump motor into the second motor operation state, thereby enabling the second pump motor to be driven by the hydraulic oil discharged by the first pump motor, a first regeneration mode of bringing the pressure release changeover valve into the closed state, and bringing the second pump motor into the second pump operation state, thereby enabling the hydraulic oil discharged by the second pump motor to be introduced into the first accumulator, and a second regeneration mode of bringing the pressure release changeover valve into the open state, and bringing the first pump motor into the first motor operation state, thereby enabling the first pump motor to operate as a motor by way of the pressure release from the second accumulator to the first pump motor; and an operation apparatus that receives an operation for a command for the driving of the first driving subject; and a circuit switching control unit that switches the mode of the circuit switching unit based on the operation given to the operation apparatus, wherein the circuit switching control unit switches the circuit switching unit to the drive mode while such a condition that an operation of driving the first driving subject at a constant speed or an operation of accelerating the first driving subject is given to the operation apparatus is required as a necessary condition, switches the circuit switching unit to the first regeneration mode while such a condition that an operation of decelerating the first driving subject is given to the operation apparatus is required as a necessary condition, and switches the circuit switching unit to the second regeneration mode while such a condition that the operation relating to the driving of the first driving subject is not given to the operation apparatus is required as a necessary condition.

2. The hydraulic driving apparatus for work machine according to claim 1, wherein the pressure holding valve is a line opening/closing changeover valve that is provided at a position between the first accumulator and the first pump motor in the first pump motor line, and can be switched between an open state of bringing the first pump motor line into a communication state and a closed state of blocking the first pump motor line.

3. The hydraulic driving apparatus for work machine according to claim 1, wherein the pressure holding valve is an accumulator opening/closing changeover valve that is provided at a position between the first pump motor line and the first accumulator, and can be switched between an open state of causing the first pump motor line and the first accumulator to communicate with each other and a blocked state of blocking the first pump motor line and the first accumulator from each other.

4. The hydraulic driving apparatus for work machine according to claim 1, wherein:

an operation pressure of the first accumulator is higher than an operation pressure of the second accumulator; and the pressure holding valve is a check valve that is provided between the first accumulator and the first pump motor in the first pump motor line, and permits a flow of the hydraulic oil from the first pump motor to the second pump motor, and blocks a flow of the hydraulic oil from the first accumulator to the first pump motor.

5. The hydraulic driving apparatus for work machine according to claim 1, wherein:

the pressure holding valve is a line opening/closing changeover valve that is provided between the first accumulator and the first pump motor in the first pump motor line, and can be switched between an open state of bringing the first pump motor line into a communication state and a blocked state of blocking the first pump motor line; and the circuit switching unit brings the line opening/closing changeover valve into the open state in the drive mode, and brings the line opening/closing changeover valve into the closed state in the second regeneration mode.

6. The hydraulic driving apparatus for work machine according to claim 1, wherein:

the pressure holding valve is an accumulator opening/closing changeover valve that is provided at a position between the first pump motor line and the first accumulator, and can be switched between an open state of causing the first pump motor line and the first accumulator to communicate with each other and a blocked state of blocking the first pump motor line and the first accumulator from each other; and the circuit switching unit brings the accumulator opening/closing changeover valve into the open state in the first regeneration mode, and bringing the accumulator opening/closing changeover valve into the closed state in the second regeneration mode.

7. The hydraulic driving apparatus for work machine according to claim 1, wherein the circuit switching control unit further switches the circuit switching unit to the second regeneration mode while such a condition that the load on the prime mover that drives the first pump motor is equal to or more than a certain value is required as a necessary condition.

* * * * *